US005829056A

United States Patent [19]

Hubert

[11] Patent Number: 5,829,056

[45] Date of Patent: Nov. 3, 1998

[54] REFLECTIVE SAFETY APRON

[76] Inventor: Ray Hubert, 1275 Justine Dr., Kankakee, Ill. 60901

[21] Appl. No.: 941,304

[22] Filed: Sep. 30, 1997

[51] Int. Cl.[6] ..... A41D 13/04; A41D 27/00

[52] U.S. Cl. ..... 2/48; 2/51; 2/243.1

[58] Field of Search ..... 2/46, 48, 49.1, 2/49.3, 49.2, 49.4, 49.5, 50, 51, 52, 69, 75, 69.5, 80, 83, 243.1, 905, 211, 70, 88–247, 248, 249, 250, 251, 252

[56] References Cited

U.S. PATENT DOCUMENTS

| | | | |
|---|---|---|---|
| 1,136,732 | 4/1915 | Steiner et al. . | |
| 2,263,538 | 11/1941 | Freirich | 2/51 |
| 2,317,176 | 4/1943 | Byrd | 2/48 |
| 2,629,102 | 2/1953 | Howells | 2/51 |
| 2,697,465 | 12/1954 | Johnson . | |
| 2,756,430 | 7/1956 | West | 2/48 |
| 3,032,773 | 5/1962 | Piazze | 2/49.1 |
| 3,131,399 | 5/1964 | Murphy et al. | 2/48 |
| 3,231,898 | 2/1966 | Yablon | 2/48 |
| 3,470,639 | 10/1969 | Ihling . | |
| 3,602,916 | 9/1971 | Aach | 2/48 |
| 3,953,893 | 5/1976 | Byrnes, Sr. | 2/51 |
| 4,248,500 | 2/1981 | Pernicano et al. | 350/98 |
| 4,392,901 | 7/1983 | Pernicano et al. | 156/155 |
| 4,401,494 | 8/1983 | Pernicano et al. | 156/155 |
| 4,646,365 | 3/1987 | Suprise et al. | 2/49.1 |
| 5,088,123 | 2/1992 | MacDonald . | |
| 5,745,917 | 5/1998 | Dicker et al. | 2/69 |

*Primary Examiner*—Jeanette E. Chapman
*Attorney, Agent, or Firm*—Hill & Simpson

[57] ABSTRACT

A reflective safety garment in the form of an apron to be worn around a person's waist is provided. The apron includes a sheet of mesh material with an upper pocket accommodating a waistband that attached the apron around the waist and a lower pocket that accommodates a strip of brightly colored reflective material. The apron is preferably worn over a portion of the user's body (i.e. buttocks, hip or pelvic area) that is facing oncoming traffic.

15 Claims, 1 Drawing Sheet

REFLECTIVE SAFETY APRON

BACKGROUND OF THE INVENTION

The present invention relates generally to safety garments and, more specifically, to brightly colored, reflective safety garments worn in emergency situations on roads and highways.

Reflective safety garments are known. However, currently available reflective safety garments come in two typical styles. One style is the commonly used safety vest worn by highway construction workers. The vest is similar in configuration to life preservers and is worn over the shoulders and tied in the front. It is necessary for the user of such a safety vest to wear a shirt underneath because the mesh fabric from which these garments are woven is typically irritating to bare skin. Thus, the typical safety vest is not suitable for runners or bicycle riders who may choose to go without a shirt or without a shirt that covers the entire upper body.

Another commonly found form of safety garments is provided in the form of a belt that includes straps that extend over the shoulders and is buckled about the waist. These belts are commonly used by crossing guards. However, like the safety vest, the fabric from which the belts are made can be irritating to the bare skin and therefore the user must wear a shirt or other garment underneath the belt. Further, the buckles used to attach the belt around the waist are bulky and can rub against the skin of a runner or bicycle rider thereby causing irritation. Further, belts without the shoulder straps and that simply extend around the waist are not wide enough to provide sufficient visibility at night.

Therefore, there is a need for an improved safety garment for use by runners and bicycle riders that provides effective visibility at dusk and at night and that does not need to be worn around the upper body. Further, because the currently available safety belts are bulky and large, they are not easily transported in the glove compartment of a car or in the emergency safety kit provided with modern automobiles. Therefore, in addition to satisfying the needs of runners, bicycle riders and walkers discussed above, there is a need for an improved safety garment that is very compact and that will fit into the safety kit or first aid kit of an automobile or that will easily fit into the glove compartment or other small compartment of an automobile.

SUMMARY OF THE INVENTION

The present invention satisfies the aforenoted needs by providing a safety apron that is attached around the user's waist by a thin waistband. The apron includes a single sheet of brightly colored mesh material with an upper edge that is folded over and sewn onto an upper portion of the sheet to form a top pocket through which the waistband is extended. The bottom edge of the sheet is folded upward and sewn onto a lower portion of the sheet to form a bottom pocket which accommodates a strip of brightly colored reflective material. The two opposing ends of the bottom pocket are sewn so as to maintain the position of the reflective strip inside the bottom pocket.

The mesh material is preferably brightly colored for enhanced visibility. One preferred color is the traditional safety orange material; other preferred colors include bright yellow or lime green.

The strip of reflective material preferably includes one surface that is brightly colored with an appropriate safety color or phosphorescent colorant and also includes a reflective surface for enhanced visibility at night in the headlights of a car or truck. In an embodiment, the mesh material may also have phosphorescent properties.

The waistband is preferably elastic material and the two ends of the waistband are preferably connected together after extending through an adjustable fastener. In an embodiment; the waistband is an elastic cord.

It is therefore an advantage of the present invention to provide a safety garment that is lightweight and compact.

Another advantage of the present invention is to provide a safety garment that can be comfortably worn around the waist and that at least partially covers the buttocks.

Another advantage of the present invention is that it provides a safety garment that can be comfortably worn around the body so that it is directed at oncoming traffic. For example, the bulk of the garment may be draped over either hip, the buttocks or the pelvic area.

Still another advantage of the present invention is to provide a safety garment that can be comfortably worn for extended periods of time without a shirt.

Yet another advantage of the present invention is to provide an improved safety garment for runners.

Another advantage of the present invention is to provide an improved safety garment for walkers.

Another advantage of the present invention is to provide an improved safety garment for bicycle riders.

Another advantage of the present invention is to provide an improved safety garment that can be used by a motorist around the waist in the event of mechanical breakdown on the highway. More specifically, by covering the buttock area, the motorist can change a tire disposed adjacent to oncoming traffic and be assured that the safety garment will be seen by oncoming motorists.

Yet another advantage of the present invention is that it provides an improved safety garment that is worn around the waist and over the buttock which is therefore more visible than a vest-type garment when used by a motorist changing a tire along a roadside because with a vest-type garment, the motorist's arms typically block most of the vest from view by oncoming motorists.

And another advantage of the present invention is that it provides an improved safety garment that is more visible to oncoming motorists when the user is bent over or in a kneeling position.

Other advantages and objects of the present invention will become apparent upon reading the following detailed description and appended claims, and upon reference to the accompanying drawings.

BRIEF DESCRIPTION OF THE DRAWING

For a more complete understanding of this invention, reference should now be made to the embodiment illustrated in greater detail in the accompanying drawing and described below by way of an example of the invention.

In the drawing.

Figure 1:
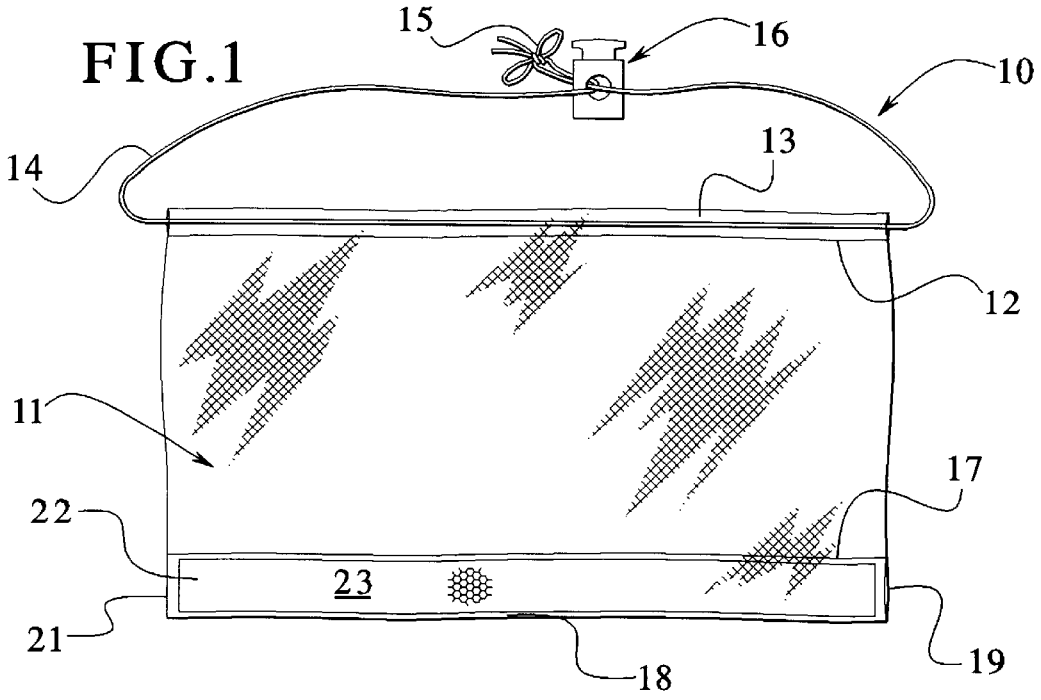
FIG. 1 is an elevational view of a safety apron made in accordance with the present invention.
Figure 2:
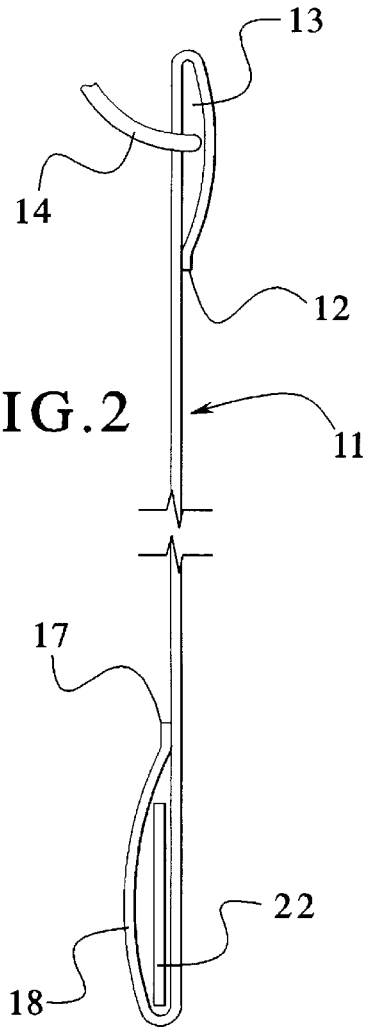
FIG. 2 is a partial side view of the safety apron shown in FIG. 1.
Figure 3:
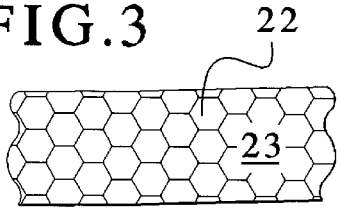
FIG. 3 is a partial elevational view of the strip of reflective tape incorporated into the safety apron shown in FIG. 1.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE DRAWING INCLUDING THE PRESENTLY PREFERRED EMBODIMENTS

Turning first to FIG. 1, a safety apron 10 is illustrated. The apron 10 includes a brightly colored sheet 11 of mesh material. The top edge 12 of the sheet has been folded over downward and sewn onto an upper portion of the sheet thereby providing a top pocket 13 for accommodating a portion of a waistband 14. The waistband 14 extends through the top pocket 13 and the opposing ends of the waistband are tied together in a knot 15 after they have passed through an adjustable connector 16.

Figure 4:
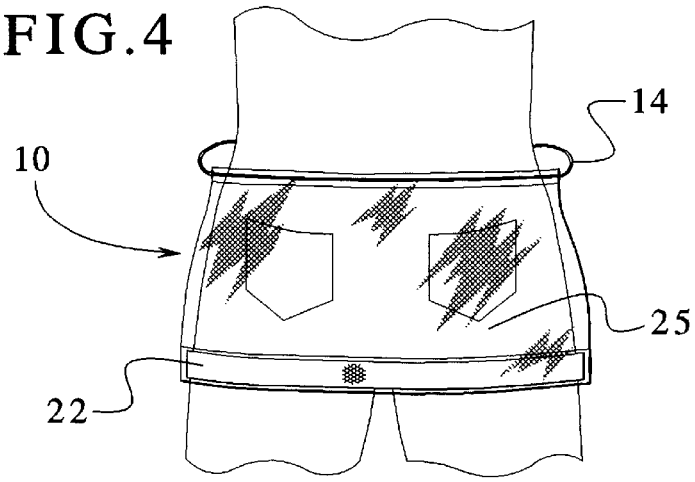
FIG. 4 is a partial elevational view of a safety apron as worn about the waist of a user.

A bottom edge 17 of the sheet 11 has been folded upward and sewn onto a lower portion of the sheet 11 thereby creating a bottom pocket 18. The ends 19, 21 of the bottom pocket have been sewn together. The pocket accommodates a strip 22 of reflective material that includes a brightly colored highly reflective surface 23 that faces outward when worn about the waist as shown in FIG. 4.

Preferably the sheet 11 is fabricated from a mesh material so that it is lightweight, collapsible and comfortable in hot weather. The material should also be brightly colored such as orange or yellow. One suitable material is a mesh material sold under the product number 9675A by Douglas Net Company of St. Anne, Ill.

The reflective tape 22 is intended to enhance the visibility of the apron 10. The reflective tape 22 should have at least one side 23 that is brightly colored and highly reflective. One suitable reflective tape sold under the trademark GLO-FLEX by American Ingenuity of Springfield, Mass.

The waistband 14 may be a string or other strap-type material. One preferred embodiment for the cord 14 is a simple elastic cord that can be easily tied together in a knot 15 after it has passed through the adjustable connector 16. Suitable elastic cords are sold by Lea & Sachs of Des Plaines, Ill. Adjustable connectors like that shown at 16 are commonly available. Suitable connectors are sold by Granat Industries Inc. of Chicago, Ill.

The position of the apron 10 during use is illustrated in FIG. 4. As shown in FIG. 4, the waistband 14 may be extended around the waist and slightly below the waistline so that the user's buttocks 23 are covered. Also, the waistband 14 may be adjusted so that the sheet 11 drapes over the portion of the body facing oncoming traffic. Specifically, the sheet 11 may be draped over either hip or the pelvic area in addition to the buttocks. Accordingly, the user need not be wearing a shirt in order to comfortably wear the apron Further, if the user is wearing the apron 10 when changing a tire along a busy roadside or highway, when bending down, the apron 10 will extend outward toward the roadside thereby assuring that the user is clearly seen by oncoming traffic. Further, even though the safety apron 10 provides excellent visibility due to its strategic placement about the buttocks of the user, it is very lightweight and very compactible thereby enabling it to be provided with an automobile safety kit or to be easily stored in the glove compartment of an automobile. It will also fold up and easily fit into a backpack, or pocket of jogging pants or sweatshirt.

From the above description, it is apparent that the advantages and objects of the present invention have been achieved. While only one embodiment has been set forth, alternative embodiments and various modifications will be apparent from the above description to those skilled in the art. For example, the mesh material used for the sheet 11 can be varied and other alternative materials are available. In addition, the preferred reflective tape material 22 may also change, depending upon the development of new products. These and other alternatives are considered equivalents and within the spirit and scope of the present invention.

What is claimed is:

1. A safety apron for attachment around a user's waist so that the apron covers at least a portion of the user's body that is facing oncoming traffic, the apron comprising:

a sheet of brightly colored mesh material, the sheet having an upper portion with a top edge and a lower portion with a bottom edge, the top edge being folded over in a downward direction and attached to the upper portion of the sheet to form a top pocket with two opposing open ends, the top pocket accommodating part of a waist band for attaching the apron to the user's waist, the bottom edge of the sheet being folded over in an upward direction and attached to the lower portion of the sheet to form a bottom pocket, the bottom pocket having two opposing closed ends and accommodating a strip of reflective material, the strip of reflective material being visible through the mesh material.

2. The apron of claim 1 wherein the bottom pocket is spaced from about 6 inches to about 10 inches below the top pocket when the apron is suspended from the user's waist so that the apron covers at least a portion of the user's buttocks.

3. The apron of claim 1 wherein the reflective tape faces outward when the apron is suspended from the user's waist.

4. The apron of claim 1 wherein the reflective tape is phosphorescent.

5. The apron of claim 1 wherein the mesh material of the sheet is phosphorescent.

6. The apron of claim 1 wherein the reflective tape is further characterized as being GLO-FLEX® tape.

7. The apron of claim 1 wherein the material is further characterized as being a netting.

8. The apron of claim 1 wherein the waist band is elastic.

9. The apron of claim 1 wherein the waist band is further characterized as having two opposing ends that are connected and that extend through an adjustable fastener for adjusting the tension of the waist band around the user's waist.

10. A highly visible and reflective safety apron for attachment around a user's waist so that the apron covers at least part of the user's body that faces oncoming traffic, the apron comprising:

a sheet of brightly colored mesh material, the sheet having an upper portion with a top edge and a lower portion with a bottom edge, the top edge being folded over in a downward direction and attached to the upper portion of the sheet to form a top pocket with two opposing open ends, the top pocket accommodating part of an elastic waist band for attaching the apron to the user's waist, the bottom edge of the sheet being folded over in an upward direction and attached to the lower portion of the sheet to form a bottom pocket, the bottom pocket having two opposing closed ends and accommodating a strip having at least one brightly colored reflective surface that faces outward when the apron is attached around the user's waist, the strip of reflective material being visible through the mesh material.

11. The apron of claim 10 wherein the bottom pocket is spaced from about 6 inches to about 10 inches below the top pocket when the apron is suspended from the user's waist and the top and bottom edges each have a length ranging from about 12 inches to about 24 inches so that the apron covers at least a portion of the user's buttocks.

12. The apron of claim 10 wherein the reflective tape is phosphorescent.

13. The apron of claim 10 wherein the mesh material of the sheet is phosphorescent.

14. The apron of claim 10 wherein the reflective tape is further characterized as being GLO-FLEX® tape.

15. The apron of claim 10 wherein the material is further characterized as being a netting.

* * * * *